US006964186B1

(12) United States Patent
Strasser et al.

(10) Patent No.: US 6,964,186 B1
(45) Date of Patent: Nov. 15, 2005

(54) ADHERING ANCHOR AND DEVICE FOR DEFORMING AREAS OF A VEHICLE BODY

(75) Inventors: Martin Strasser, Donau-Eschingen (DE); Michael Gabriel, Alfdorf (DE)

(73) Assignee: MV Marketing und Vertriebs-GmbH & Co. KG, Schwennigen (DE)

( * ) Notice: Subject to any disclaimer, the term of this patent is extended or adjusted under 35 U.S.C. 154(b) by 0 days.

(21) Appl. No.: 10/130,001

(22) PCT Filed: Nov. 9, 2000

(86) PCT No.: PCT/EP00/11073

§ 371 (c)(1),
(2), (4) Date: Sep. 23, 2002

(87) PCT Pub. No.: WO01/34316

PCT Pub. Date: May 17, 2001

(30) Foreign Application Priority Data

Nov. 9, 1999 (DE) ..... 299 19 634 U
Feb. 29, 2000 (DE) ..... 200 03 647 U

(51) Int. Cl.[7] ..... B21J 9/18

(52) U.S. Cl. ..... 72/454; 72/457; 72/705; 72/342.8

(58) Field of Search ..... 72/295, 296, 316, 72/342.4, 342.8, 389.1, 390.7, 454, 457, 458, 705

(56) References Cited

U.S. PATENT DOCUMENTS 3,712,106 A * 1/1973 Holsapple et al. ..... 72/309
4,089,201 A 5/1978 Raptis
4,116,035 A * 9/1978 Malarsky ..... 72/389.6
5,026,187 A * 6/1991 Belanger et al. ..... 401/1
5,203,196 A 4/1993 Jenkins
5,943,902 A * 8/1999 Ishihara ..... 72/451
5,951,818 A * 9/1999 Gaetano ..... 156/535

FOREIGN PATENT DOCUMENTS

DE 196 46 101 A1 8/1996 ..... B21D/1/06
EP 0 783 926 A1 7/1997 ..... B21D/1/12

OTHER PUBLICATIONS

"Ding King", do it yourself dent repair, Ding King Co. 1993–2003.*

* cited by examiner

*Primary Examiner*—Ed Tolan

(57) ABSTRACT

The invention relates to a device for deformation, in particular for restoring deformed bodywork regions, having a pulling device to which an adhesive bolt can be fastened, the adhesive bolt being fastenable by adhesion to the bodywork region to be deformed.

32 Claims, 7 Drawing Sheets

ADHERING ANCHOR AND DEVICE FOR DEFORMING AREAS OF A VEHICLE BODY

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates to a device for deformation, in particular for restoring damaged bodywork regions, which can advantageously be used in areas of concern involving the motor-vehicle bodywork trade.

TECHNICAL FIELD

In the repair sector of the motor-vehicle bodywork trade, in particular, great importance is attached to removing damage to a bodywork in an as effective and as high-quality manner as possible, in an environment which is continuously becoming more difficult.

In motor vehicles today, use in increasingly being made of different materials, for example aluminum, plastics and fiber-reinforced plastics, which can be processed only with difficulty using conventional means during repair. Moreover, panels having various thicknesses are used, which means that the force to be applied for restoring them differs greatly, and certain manual processes, for example knocking out the dent with a hammer or a pulling hammer, are becoming more and more difficult.

In accordance with the current state of knowledge, the conventional, "gentle" repair is normally carried out using various straightening irons by pressing back the panel from below the panel.

An adhesive technique is also being offered. This technique envisages repairing large dents using a pulling hammer. However, the adhesive stoppers which are used are too large for the small dents caused by hail and have therefore frequently been correspondingly cut off in order to reduce their diameters. This method has been used particularly in the case of panel sections which are inaccessible from below or from the rear side. This technique does work with appropriate training, but has serious deficiencies. Hitting with the pulling hammer is too imprecise, which means that there is the risk of the pulling being undertaken with too little or too much force. The dent therefore has relatively frequently to be additionally processed. This means that in many cases the dent has had to be knocked out to an excessive extent and then knocked back again with the Teflon calker, which, as a rule, has necessitated time-consuming subsequent grinding and polishing.

Furthermore, because of frequent tilting of the large pulling hammer, the adhesive stoppers have been so badly affected that they break off. Similarly, during pulling hammer blows cars which have already been painted and leveled out frequently partially loose the paint or the paint and the filler is knocked off.

The present invention is intended to make possible deformations, such as restorations or repairs of dents, without having to be painted and without, for example, the roof lining or other add-on parts having to be removed.

Furthermore, repair to the panel from the outside as rapidly and exactly as possible is to be assisted, with very little environmental impact.

SUMMARY OF THE INVENTION

This object is achieved in an astonishingly simple manner simply by a deformation device for restoring deformed bodywork regions, comprising an adhesive bolt and a pulling device to which the adhesive bolt can be fastened. The adhesive bolt being fastenable by adhesion to the bodywork region to be deformed. The pulling device comprises a counter holder having a hole for receiving the adhesive bolt and supporting plates that are spaced apart from each other and have articulated feet. Compared to restoration by hitting, here a defined pulling is made possible, since instead of a hitting device a pulling device is used which enables force to be transmitted under constant control without substantial force peaks and with an exact stroke. For this purpose, use is made of a pulling device to which an adhesive bolt can be fastened, the adhesive bolt being attached by adhesion to the bodywork region to be deformed.

In this case, it is of great advantage that the adhesive bolt can be designed in its region facing the panel to be of such a small size that even dents caused by the impact of hail can be detected in depth and restored.

For this purpose, it is advantageous if the adhesive bolt has an adhesive stopper which is essentially in the form of a truncated cone and has a textured adhesive surface on its lower side, since the textured adhesive surface enables the effective surface available for application of adhesive to be increased, and a substantially higher tensile force can thereby be absorbed and a very high stability is provided by the truncated cone shape.

In this connection, it is also advantageous if the textured adhesive surface has ribs running radially or the textured adhesive surface is grooved.

If the lower side of the adhesive stopper has a curvature which recedes outward in the pulling direction, the tool can also be used at rounded locations on the bodywork or, in the case of damage running obliquely with respect to the surface, oblique pulling for optimum restoration can take place.

Depending on the damage, the lower side of the adhesive stopper is round, oval, square, tetragonal, rectangular, trapezoidal, polygonal or is processed as desired by the user, in order to enable force to be introduced in the best possible manner into the damaged bodywork region.

In the case of a cost-effective, robust embodiment, for the purpose of support against the bodywork use is made of an elongated counter holder having a web which consists of plastic or of metal and in the center has a hole through which the threaded rod can be guided.

In order to better adapt the support of the tool, the counter holder has a respective through groove on two sides in order to allow lateral displacement of a respective supporting plate held in each case in a through groove.

In order to assist oblique pulling or pulling at rounded bodywork regions, the supporting plates have articulated feet having integrated threaded rods.

A very secure pulling, which is secured against slipping, is made possible if the supporting plates have a rubber support on their lower side and are both pivotable and rotatable in the joint of the articulated foot. The maneuverability of the device is thereby also greatly improved.

As an alternative, the supporting plates have a suction foot or a magnetic foot on their lower side.

If the joint of the articulated foot comprises a spherical head joint whose pivoting point lies in the vicinity of the contact surface of the supporting plates and preferably comprises a flattened spherical head having a flattened spherical head socket whose effective pivoting point lies in the plane of the bodywork region to be processed, an oblique, lateral pulling can take place without substantial forces occurring which attempt to change the pulling direction.

Great advantages in terms of time are produced if an adhesive bolt is used having a device for applying the adhesive on and/or removing it from the bodywork region to be processed. An adhesive bolt of this type may, for example, comprise a device for heating a hot-melt adhesive, for example together with a sleeve having a through hole in which lateral pushing elements are arranged in order to hold a hot-melt adhesive cartridge in a manner such that it can be displaced longitudinally in the forward direction and such that it is blocked in the rearward direction.

A further saving on time is produced by a device for cooling the hot-melt adhesive, which device preferably contains a device for supplying a cooling medium, such as air or cooling liquid.

A virtually entirely automated sequence of movement during the restoration is made possible by a device for triggering the heating, comprising, in particular, an electric switch or a piezoelectric element, which, from a certain contact pressure force, triggers an electronic circuit for controlling the heating.

Very high heating-up speeds are made possible by a device for detecting the temperature of the hot-melt adhesive, which device is assigned to an electric control device for controlling the temperature of the adhesive bolt.

A further reduction in the temporal sequence is made possible by a device for removing the heated hot-melt adhesive.

BRIEF DESCRIPTION OF THE DRAWINGS

The invention will be explained in more detail below with reference to preferred embodiments and with reference to the attached drawings, in which.

DETAILED DESCRIPTION OF THE INVENTION

Figure 1:
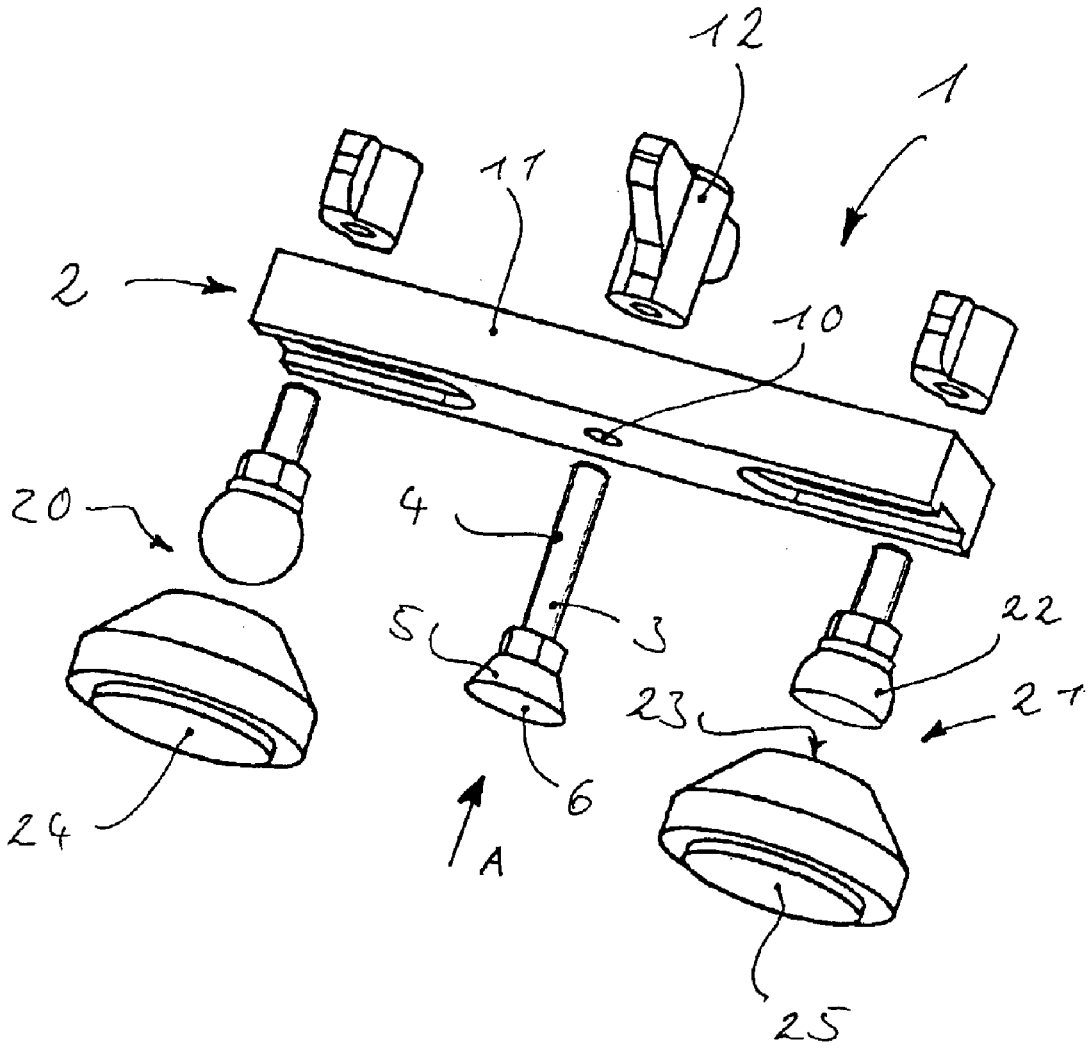
FIG. 1 shows, in an exploded illustration obliquely from the front, a perspective view of a first embodiment according to the invention of a device for deforming bodywork regions.
Figure 2:
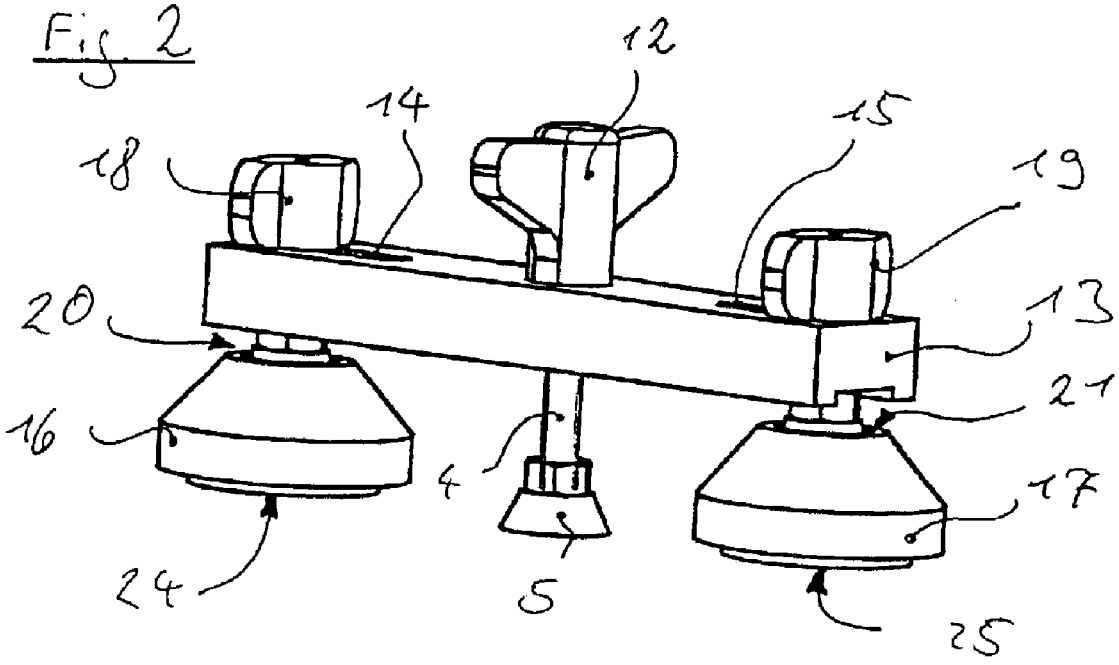
FIG. 2 shows a perspective view of the first embodiment according to the invention, which is illustrated in FIG. 2, in an assembled position ready for use.
Figure 3:
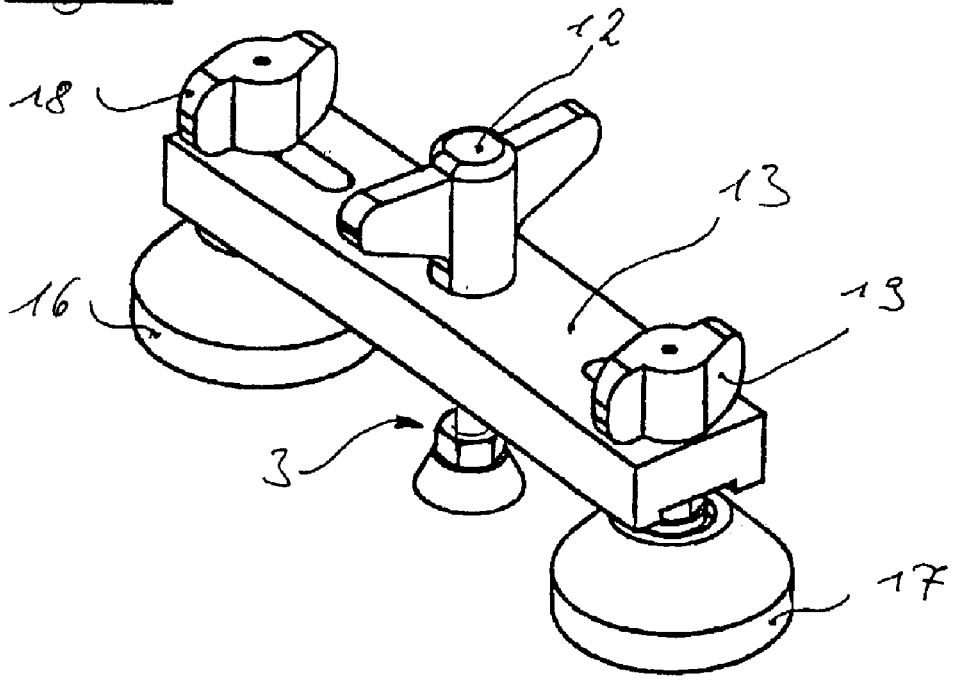
FIG. 3 shows, obliquely from above, a perspective view of the first embodiment according to the invention, which is illustrated in FIGS. 1 and 2, in an assembled position ready for use.

The invention will be described in more detail below, the figures, for the purpose of better understanding, not being illustrated to scale.

A first embodiment of the device according to the invention, which is shown in an exploded illustration in FIG. 1, will be described below.

The device which is denoted in its entirety by 1 comprises a pulling device 2 which is suitable for pulling an adhesive bolt 3 in a defined and jerk-free manner in the direction of the arrow A, therefore away from a bodywork region 9 to be processed.

A further automatic device for pulling the adhesive bolt 3 is described, for example, in the European patent having the publication number EP 94 113 097.3, the contents of which are incorporated in full also in the subject matter of the present application. When a pulling device of this type is used, instead of the threaded rod 4 of the adhesive bolt 3 use can be made of a rod having a bayonet or another desired outer form, in order to hold said rod in the pulling device.

Furthermore, the adhesive bolt 3 is an item which can be maneuvered and handled independently and with which many advantages of the invention can also be achieved together with other pulling devices already commercially available.

The adhesive bolt 3 furthermore comprises an adhesive stopper 5 which is essentially in the form of a truncated cone and has a textured adhesive surface on its lower side 6, by means of which the available surface area and tensile forces which can thereby be effectively achieved are increased.

Figure 4:
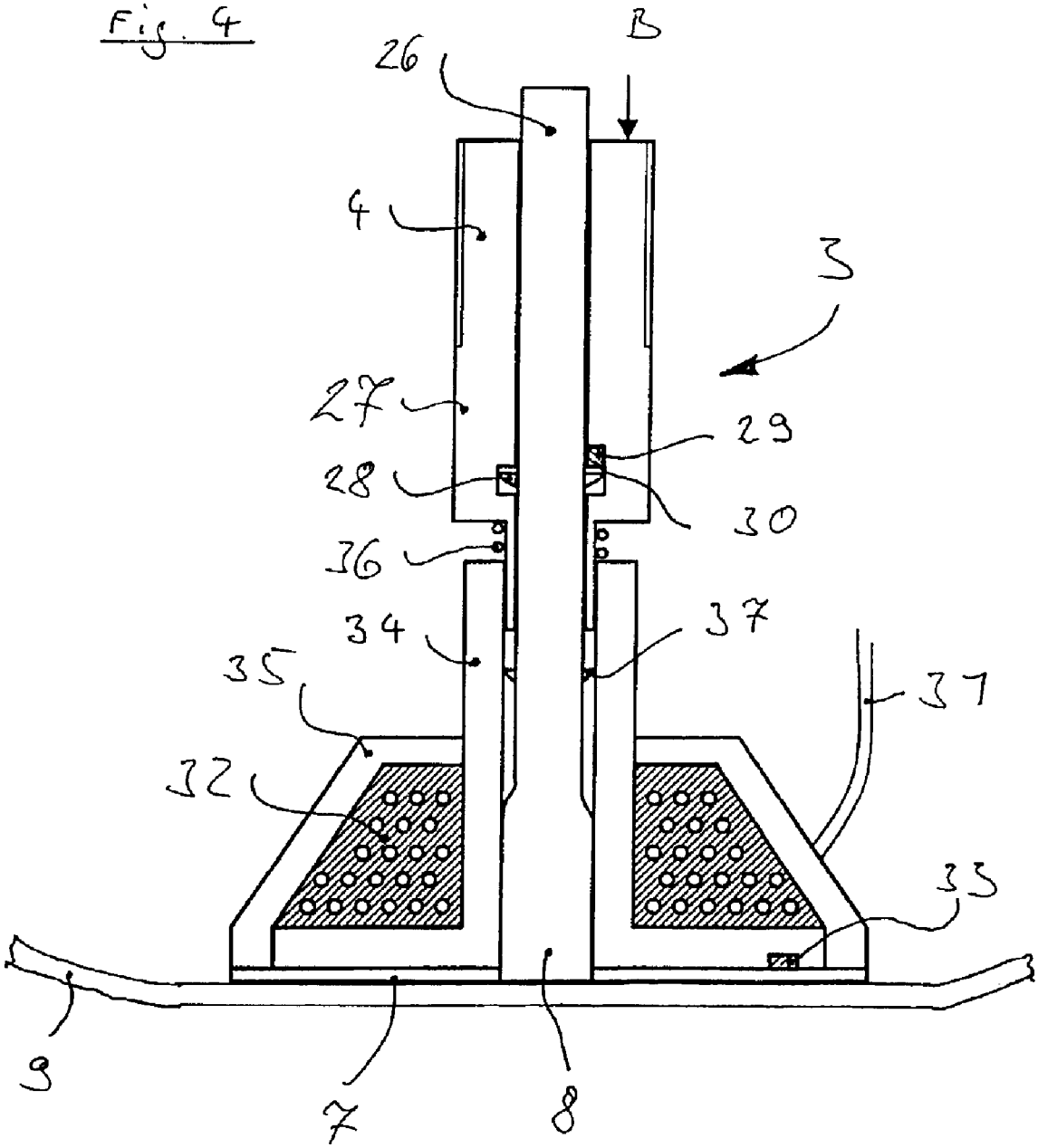
FIG. 4 shows a cross-sectional illustration of an adhesive bolt having a device for supplying adhesive and an electrically controlled device for heating the adhesive.
Figure 5:
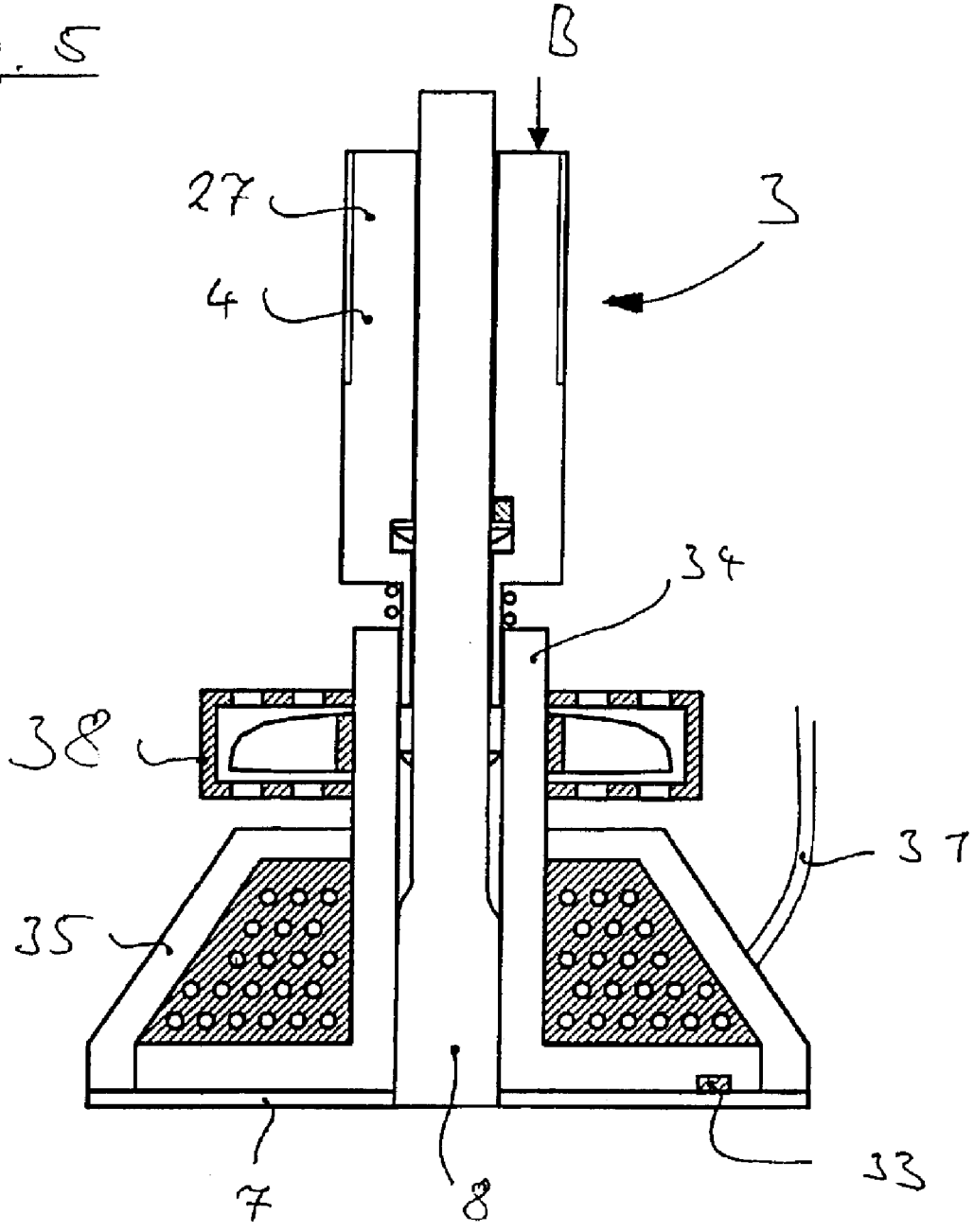
FIG. 5 shows a cross-sectional illustration of an adhesive bolt, which has been developed further in comparison to the one illustrated in FIG. 4, having a device for supplying cooling medium for cooling the hot-melt adhesive.
Figure 6:
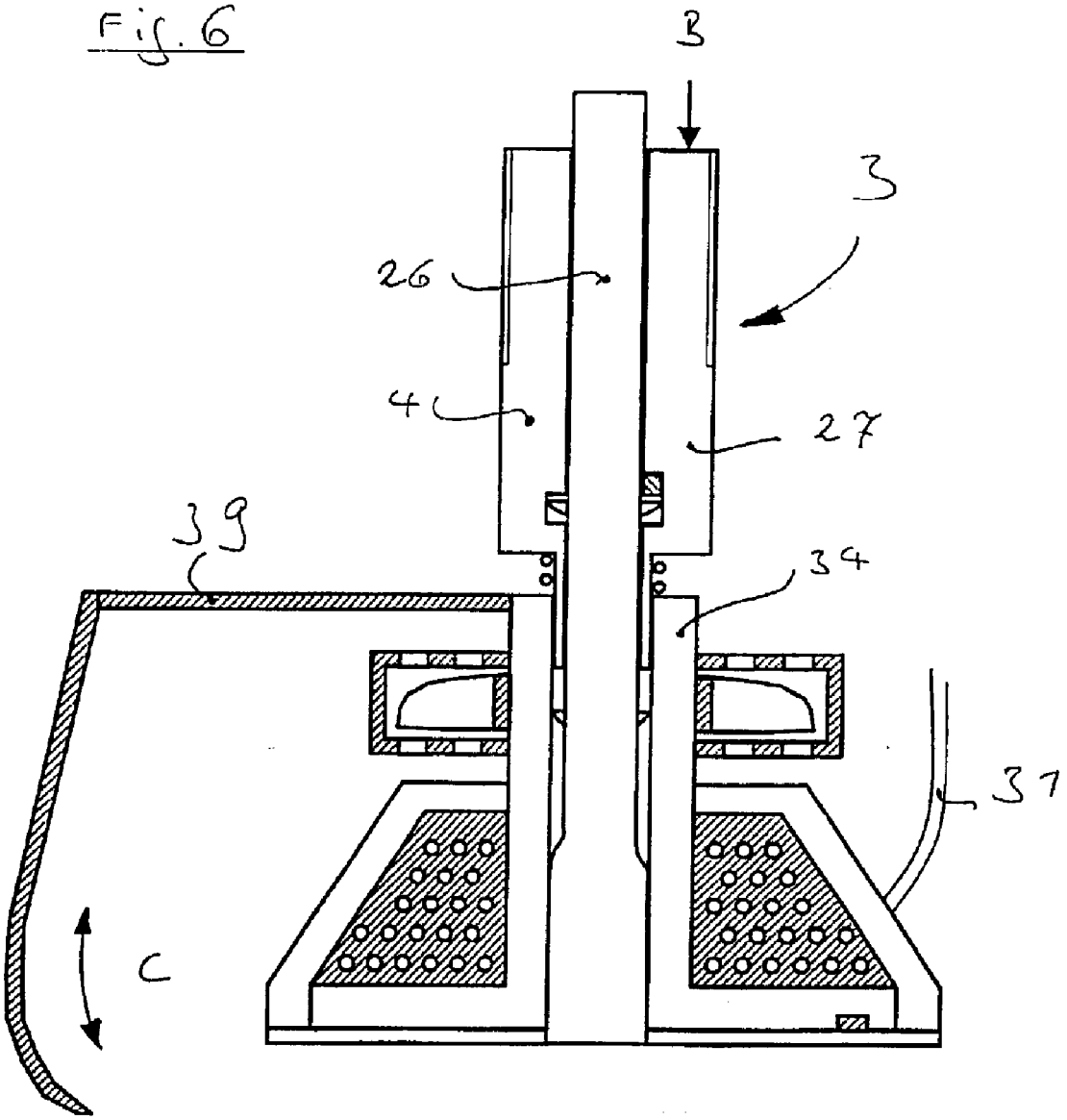
FIG. 6 shows a cross-sectional illustration of an adhesive bolt, which has again been further developed in comparison with the adhesive bolts illustrated in FIG. 4 and FIG. 5, having a device for removing the hot-melt adhesive.

In the embodiments of the adhesive bolt 3 which are illustrated in FIGS. 4 to 6 the lower side 6 has ribs 7 which run radially and through which, for example heated hot-melt adhesive 8 can pass from a heated, inner, hot zone to the outside and thus fine channels between the lower side 6 and the bodywork panel 9 are produced, in which high adhesive forces can be achieved.

Furthermore, by means of the threaded rod 4 which extends through an opening 10 running through a counter holder 1, the adhesive stopper 5 can be held, using a wing nut 12, in a manner such that it can be displaced in the direction of the arrow A and counter to said direction.

The counter holder 11 comprises a web 13 having two longitudinal grooves 14, 15 in which supporting plates 16, 17 are held in a manner such that they can be displaced laterally and can be locked in place using wing nuts 18, 19. For this purpose, the supporting plates 16, 17 have corresponding threaded rods which merge into joints 20, 21.

In a preferred embodiment, the joints 20, 21 are spherical head joints and have, as can be seen in the case of the right-hand joint 21 from FIG. 1, a flattened spherical head 22 and a flattened spherical head socket 23, with the result that the effective rotating and pivoting point of the spherical head joint lies approximately in the plane of the bodywork region 9 to be processed.

A rubber support is attached to the lower sides 24, 25 of the supporting plates 16, 17 or, as an alternative, suction feet or magnetic feet are interchangeably attached, in order always to ensure a secure and slip-free pulling process.

This also makes possible a secure support on rounded bodywork region, in which the lower side 6 of the adhesive bolt 3 likewise does not have to run in a planar manner, but rather, depending on the embodiment, can have corresponding bent or rounded portions which recede, in particular, in the pulling direction.

Furthermore, in a further preferred embodiment, the adhesive stopper 5 is produced from a plastic which can be processed by cutting, with the result that the lower side 6 assumes any desired forms, for example round, oval, square, tetragonal, rectangular, trapezoidal or polygonal forms, which was adapted in an optimum manner by the user to the damage present in each case.

In the first embodiment according to the invention a repair is generally carried out as follows.

The location to be processed is cleaned and a small, heated hot-melt adhesive stopper, approximately hazelnut in size, is applied.

The stopper, is preferably placed in the dent in a centered manner, the adhesive compound, which is approximately the size of a hazelnut kernel, being passed onto the indentation from the hot-melt adhesive gun. The wing nut is now screwed on by the internal thread.

After the adhesive has cooled (after approximately 1 minute), the threaded rod, and therefore the indented panel, is pulled upward by means of rotation of the wing nut toward the counter holder (corkscrew effect). Since these repair operations are preferably carried out with a neon light which is placed in such a manner that the light strip is reflected in the dent corresponding to the bent portion of the dent, it can very easily be observed how the indentation is being deformed back by the targeted rotations of the nut. In contrast to the method using a pulling hammer, in the case of the invention it can therefore always be precisely observed how the dent is being deformed back and when this process has to end, so as to prevent excessive overstretching of the panel.

If the neon light strip forms the customary straight line, the indentation has disappeared and therefore the goal has been achieved.

Heating of the stopper by means of a hot-air fan enables the dent-extracting implement to be removed. The location can now be cleaned entirely or, if necessary, may, if appropriate, also be refinished.

This use option permits as many threaded rods/adhesive stoppers as desired to be successively stuck on and processed using the same counter holder and wing nut.

Said adhesive stoppers are placed via the threaded rod into the milling groove on both sides of the counter holder and are screwed to wing nuts.

In the following, reference is made to FIGS. 4 to 6, FIG. 4 comprising an adhesive bolt 3 having a device for applying the adhesive 26, this adhesive preferably being a hot-melt adhesive and preferably being supplied as a hot-melt adhesive cartridge 26 which is held in an upper sleeve 27 by a cup spring 28 in a manner such that it can be displaced longitudinally in the direction of the arrow B, but such that it is blocked counter to the direction of the arrow B.

If, when the adhesive bolt 3 is placed onto the panel 9 to be processed, the sleeve 27 moves in the direction of the arrow B toward the panel, the front parts of the hot-melt adhesive cartridge 26 come into contact with the panel 9 and displaces the cup spring counter to the direction of the arrow B and thereby triggers an electric switch 29 and exerts a compressive force on a piezo element 30 which is detected by an electronic circuit (not illustrated in the figures) by means of feed line 31.

The electric circuit controls a device for heating the hot-melt adhesive 32, which device, in a further preferred embodiment, comprises a thermoelectric element 33 with which a very rapid heating-up process can be carried out in a controlled manner.

After that, during further pressing of the upper sleeve 27 in the direction of the arrow B the heated hot-melt adhesive 8 emerges laterally between the ribs 7 by displacement of the sleeve 27 relative to the lower sleeve 34, in such a manner that an exactly defined application of adhesive takes place.

The quantity of adhesive to be applied can be set by setting the path of displacement of the sleeve 27 by means of stops (not illustrated in the figures).

After the heating, metallic cooling ribs 35 which are arranged on the exterior of the adhesive bolt 3 and are in very good thermal contact with the ribs 7, ensure rapid cooling and rapid hardening of the hot-melt adhesive. This cooling can be indicated to the user by means of optical or acoustic signals by the electronic device by measuring the temperature of the thermocouple 33, with the result that a secure pulling process can always be achieved.

The pulling process initiated thereafter pulls the sleeve 27 back relative to the sleeve 34 under the additional force of a compression spring 36 into an upper end stop (not illustrated in the figures) which then causes the tensile forces to be introduced into the bodywork region 9.

The hot-melt adhesive cartridge 26 is prevented from retreating by a cup spring 37, which, like the cup spring 28, may also be of split design, in the lower sleeve 34.

Following the pulling process and no later than the desired restoration or a desired, defined overstretching, the hot-melt adhesive can again be heated by the device 32 and the adhesive bolt 3 can be removed from the panel 9 in a simple manner.

If, for this process, use is made, for example, of the device which is also referred to by the manufacturer as an air puller and is described in EP 94 113 097.3, air emerging from the pneumatic system can be used in order to achieve accelerated cooling. When the air puller is used, its extended electronic control device, set with appropriate temporal parameters automatically or by the user, can take on all of the temporal control processes, such as application of adhesive by moving the adhesive bolt 3 forward, the heating and cooling of said adhesive bolt, and the subsequent pulling and reheating for releasing the adhesive bolt.

When the air puller is used, instead of releasing the adhesive by heating, a sudden twisting of the adhesive bolt 3 can also be carried out, by means of which this adhesive bolt is separated from the panel region 9.

Even without using the air puller, however, even the simple fanning of the cooling rib 35 by a pneumatic jet leads to rapid cooling.

If pneumatic cooling options of this type are not used, either liquid cooling medium available in the workshop area can be applied to the cooling ribs 35, or a dedicated electrical cooling device (illustrated for example in FIG. 5) in the form of a ventilation fan 38 can be used.

This fan 38 is likewise regulated via the electronic control device and can be actuated as a function of the temperature detected by the thermoelectric element 33 or by a turning device.

Furthermore, an embodiment, which is illustrated in FIG. 6, contains an elastic spatula 39 which can be pivoted in the direction of the arrow C and with which the adhesive which is still hot can be removed in a simple manner from the panel 9 after the adhesive bolt 3 has been removed. It is within the scope of the invention also to design this spatula 39 in a manner such that it can be heated.

Figure 7:
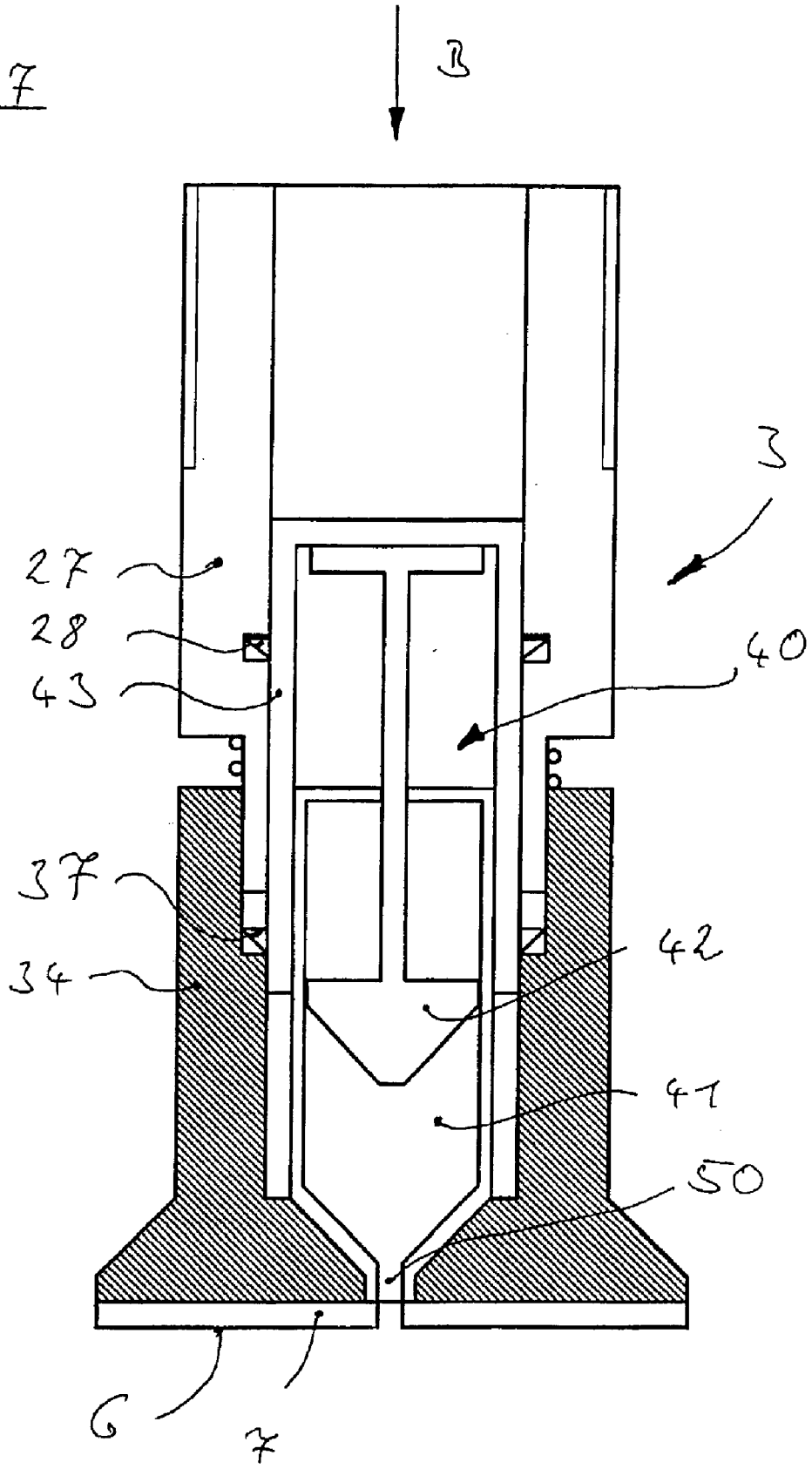
FIG. 7 shows a cross-sectional illustration of a further embodiment of an adhesive bolt having a device for supplying a liquid, single-component adhesive.
Figure 8:
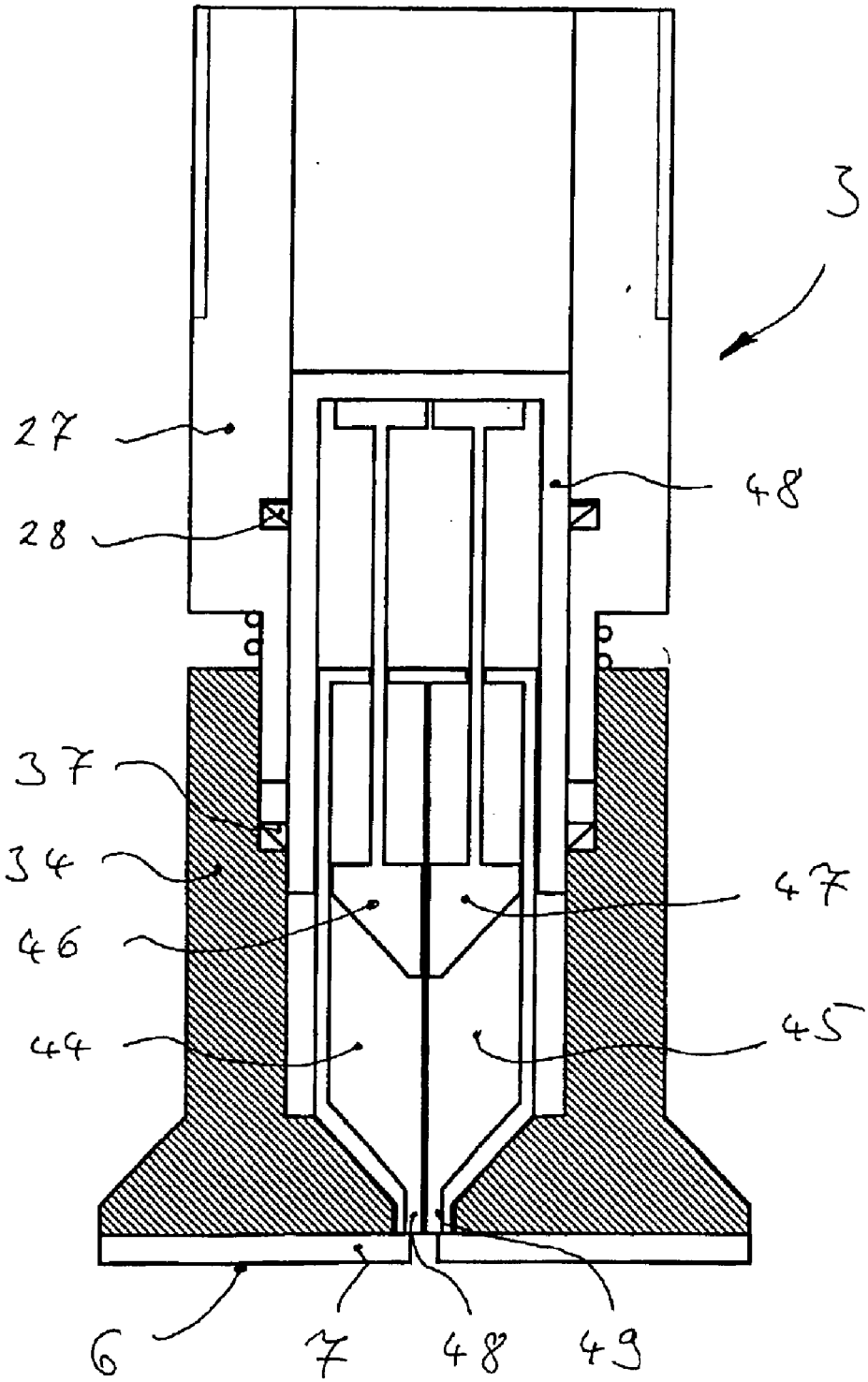
FIG. 8 shows a cross-sectional illustration of an again further embodiment of an adhesive bolt having a device for supplying a liquid, multi-component adhesive.

Two further embodiments according to the invention of the adhesive bolt 3 are illustrated in FIGS. 7 and 8, in which instead of the hot-melt adhesive use is made in each case of adhesive-containing cartridges having rapidly curing adhesives.

In the case of the embodiment illustrated in FIG. 7, an adhesive-containing cartridge 40 having a rapidly curing, liquid, single-component adhesive, for example an adhesive based on acrylate or methacrylate which cures in seconds.

The cartridge 40 contains an adhesive-containing chamber 41 in which a plunger 42 is held in a manner such that it can be displaced longitudinally in the direction of the arrow B. During each movement of the upper sleeve 27 an upper cap 43 which is connected to the plunger 42 is displaced downward by a defined amount and thereby presses the plunger 42 into the adhesive-containing chamber 41, as a result of which a defined portion of adhesive is output from the latter at its lower end through a nozzle 50, said portion passing between the lower side 6 of the adhesive bolt 3 and the surface of the panel 9 and by this means producing a predefined adhesive surface.

Furthermore, instead of the cartridge 40 a commercially available syringe filled with, adhesive can be used, said syringe initially being inserted, as illustrated in FIG. 7, into the adhesive bolt 3 and via which the cap 3 is subsequently pushed. The cap 3 is essentially moved in the same manner as has been described in the case of the hot-melt adhesive cartridge.

After the adhesive has cured, which takes place in a few seconds, the pulling process can be carried out.

At the end of the pulling process, a sudden twisting of the adhesive bolt 3 by means of the air puller enables the latter to be sheared off, and the device according to the invention is again ready for use.

In the case of a further embodiment which is illustrated in FIG. 8, the adhesive-containing cartridge contains a number of, preferably two, adhesive-containing chambers 44, 45 which each have a plunger 46, 47 which is connected to a cap 48. If, in this embodiment, the cap 48 is moved in the direction of the arrow B by the plungers 46, 47, the various components, preferably hardener and resin, of a multi-component adhesive are mixed together by the nozzles 48, 49, which are situated close to each other, and a rapid curing process of the adhesive is initiated.

In this embodiment too, release of the adhesive bolt 3 can be undertaken by shearing it off.

The invention is not restricted to the above-described embodiments and in particular is not restricted to only being applied in the case of painted panels; on the contrary, it likewise lies within the scope of the invention also to deform blank metal panels or regions which are primed or provided with filler.

What is claimed is:

1. A deformation device for restoring deformed bodywork regions (9), comprising a rigid adhesive bolt (3) and a pulling device (2, 11) to which the adhesive bolt (3) is fastenable, the adhesive bolt (3) being rigid and fastenable by adhesion to the bodywork region (9) to be deformed, wherein the pulling device (2, 11) comprises a counter holder (11) having a hole (10) for receiving the adhesive bolt (3) and supporting plates (16, 17) that are spaced apart from each other and have articulated feet (20, 21).

2. The device as claimed in claim 1, wherein the adhesive bolt (3) comprises an adhesive stopper (5) that is substantially in the form of a truncated cone and has a textured adhesive surface on its lower side.

3. The device as claimed in claim 2, wherein the textured adhesive surface (6) is designed to increase an effective surface available for application of adhesive.

4. The device as claimed in claim 2, wherein the textured adhesive surface (6) comprises radially running ribs (7).

5. The device as claimed in claim 2, wherein the textured adhesive surface (6) is grooved.

6. The device as claimed in claim 2, wherein the adhesive stopper (5) is connected to a threaded rod (4) to which a wing nut (12) is joined.

7. The device as claimed in claim 2, wherein a lower side (6) of the adhesive stopper (5) has a curvature which recedes outward in a pulling direction.

8. The device as claimed in claim 2, wherein the lower side (6) of the adhesive stopper (5) is selected from round, oval, square, tetragonal, rectangular, trapezoidal, a polygonal shape or is processed as desired by a user.

9. The device as claimed in claim 1, further comprising an elongated counter holder (11) having a web (13) comprising plastic or metal and a center hole (10) through which a threaded rod (4) is guidable.

10. The device as claimed in claim 9, wherein the counter holder has a respective through-groove (14, 15) on two sides in order to allow lateral displacement of a respective supporting plate (16, 17) held in each case in the through groove (14, 15).

11. The device as claimed in claim 10, wherein the respective supporting plates (16, 17) have the articulated feet (20, 21) having integrated threaded rods.

12. The device as claimed in claim 10, wherein the supporting plates (16, 17) have a rubber support on their lower side and are both pivotable and rotatable in a joint (20, 21) of the articulated foot.

13. The device as claimed in claim 10, wherein the respective supporting plates (16, 17) have a suction foot on their lower side.

14. The device as claimed in claim 10, wherein the respective supporting plates (16, 17) have a magnetic foot on their lower side.

15. The device as claimed in claim 12, wherein the joint (20, 21) of the articulated feet comprises a spherical head joint (22, 23) whose pivoting point lies in a vicinity of a contact surface of the supporting plates (16, 17) and comprises a flattened spherical head having a flattened spherical head socket whose effective pivoting point lies in the plane of the bodywork region (9) to be processed.

16. The device as claimed in claim 1, wherein the adhesive bolt (3) comprises a device for applying the adhesive on or removing it from the bodywork region to be processed.

17. An adhesive bolt (3) for a device as claimed in claim 1, wherein the adhesive bolt comprises a device for applying the adhesive onto the bodywork region to be processed.

18. The adhesive bolt as claimed in claim 17, comprising a device (32) for heating a hot-melt adhesive.

19. The adhesive bolt as claimed in claim 17, further comprising a sleeve (27, 34) having a through-hole in which lateral pushing elements (28, 37) are arranged to hold a hot-melt adhesive cartridge in a manner such that the adhesive cartridge is displaceable longitudinally in a forward direction (B) onto the bodywork region (9) to be processed and such that the adhesive cartridge is blocked in a rearward direction.

20. The adhesive bolt as claimed in claim 19, further comprising a device (35, 38) that cools the hot-melt adhesive (8).

21. The adhesive bolt as claimed in claim 20, further comprising a device (38) that supplies a cooling medium.

22. The adhesive bolt as claimed in claim 21, comprising metallic cooling ribs (35) arranged radially on an exterior of the adhesive bolt (3), and the cooling medium comprises air or a cooling liquid.

23. The adhesive bolt as claimed in claim 22, wherein the cooling ribs (35) are in thermal connection with ribs (7) on the lower side (6) of the adhesive bolt (3).

24. The adhesive bolt as claimed in claim 23, comprising a heat triggering device comprising, an electric switch (29) or a piezoelectric element (30), that from a certain contact pressure force, triggers an electronic circuit for controlling heating.

25. The adhesive bolt as claimed in claim 24, comprising a device (33) for detecting temperature of the hot-melt adhesive (6), which device is assigned to an electric control device for controlling temperature of the adhesive bolt (3).

26. The adhesive bolt as claimed in claim 18, further comprising a device (39) that removes heated hot-melt adhesive.

27. The adhesive bolt as claimed in claim 26, wherein the device (39) that removes heated hot-melt adhesive comprises a pivotable, heatable spatula (39).

28. The adhesive bolt as claimed in claim 17, further comprising an adhesive-containing cartridge which, when the adhesive bolt (3) is placed onto the bodywork region (9) to be processed, outputs a defined quantity of adhesive.

29. The adhesive bolt as claimed in claim 28, wherein the adhesive-containing cartridge comprises a plurality of adhesive-containing chambers having a plurality of components of a multi-component adhesive.

30. A dent puller for restoring a deformed bodywork region, comprising:

a counter holder (2, 11), said counter holder having a hole (10) in it, a bolt (3), said bolt (3) having a first end (4) provided with pulling means (12), and a second end provided with an adhesive member (56) including a surface (6) for attaching said adhesive member (5, 6) to said deformed bodywork region, said adhesive member (5, 6) being a rigid member, and a pair of feet (20, 21), fixing means (18, 19) for fixing said feet (20, 21) on said counter holder (2, 11) spaced apart from each other, and articulating means connecting said feet (20, 21) to said fixing means (18, 19), said articulating means including ball joint means (20, 22).

31. A deformation device for restoring deformed bodywork regions (9), comprising a rigid adhesive bolt (3) and a pulling device (2, 11) to which the adhesive bolt (3) is fastenable, the adhesive bolt (3) being rigid and fastenable by adhesion to the bodywork region (9) to be deformed, wherein the pulling device (2, 11) comprises a counter holder (11) having a hole (10) for receiving the adhesive bolt (3) and supporting plates (16, 17) that are spaced apart from each other and have articulated feet (20, 21), wherein the adhesive bolt comprises a device for applying the adhesive onto the bodywork region to be processed, further comprising a sleeve (27, 34) having a through-hole in which lateral pushing elements (28, 37) are arranged to hold a hot-melt adhesive cartridge in a manner such that the adhesive cartridge is displaceable longitudinally in a forward direction (B) onto the bodywork region (9) to be processed and such that the adhesive cartridge is blocked in a rearward direction.

32. A deformation device for restoring deformed bodywork regions (9), comprising a rigid adhesive bolt (3) and a pulling device (2, 11) to which the adhesive bolt (3) is fastenable, the adhesive bolt (3) being rigid and fastenable by adhesion to the bodywork region (9) to be deformed, wherein the pulling device (2, 11) comprises a counter holder (11) having a hole (10) for receiving the adhesive bolt (3) and supporting plates (16, 17) that are spaced apart from each other and have articulated feet (20, 21), wherein the adhesive bolt comprises a device for applying the adhesive onto the bodywork region to be processed, further comprising an adhesive-containing cartridge which, when the adhesive bolt (3) is placed onto the bodywork region (9) to be processed, outputs a defined quantity of adhesive.

* * * * *